US005865050A

United States Patent [19]

Michaud et al.

[11] Patent Number: 5,865,050

[45] Date of Patent: Feb. 2, 1999

[54] LOCKING COVER FOR DEAD BOLT ACTUATORS

[76] Inventors: Yves Michaud, 912 18 Ct., Apt. 102, Hollywood, Fla. 33020; Alain Belanger, 2861 Edge Hill La., Cooper City, Fla. 33026

[21] Appl. No.: 731,327

[22] Filed: Oct. 15, 1996

[51] Int. Cl.[6] ..... E05B 13/08

[52] U.S. Cl. ..... 70/416; 70/471; 70/476; 70/482; 70/483; 70/DIG. 62; 295/150; 295/347

[58] Field of Search ..... 70/416, DIG. 6, 70/DIG. 62, 467–469, 471, 473, 474, 476, 477, 480–483, 152, 210; 292/150, 347

[56] References Cited

U.S. PATENT DOCUMENTS

| | | | |
|---|---|---|---|
| 1,495,820 | 5/1924 | Tierney | 70/416 |
| 5,000,498 | 3/1991 | Upchurch | 70/416 X |
| 5,313,812 | 5/1994 | Eklund et al. | 70/416 |
| 5,421,074 | 6/1995 | Moore | 70/416 X |
| 5,515,704 | 5/1996 | Van Nguyen | 70/416 |
| 5,551,188 | 9/1996 | Davlantes | 70/455 X |

*Primary Examiner*—Lloyd A. Gall
*Attorney, Agent, or Firm*—J. Sanchelima

[57] ABSTRACT

A locking cover for a dead bolt lock assembly that permits a user to put it in one of three positions: neutral, locked and unlocked. The cover in the neutral position permits the operation of the bolt lock assembly normally. The other positions limit the rotational travel of the actuating shaft to one quarter of a turn. The actuating shaft is rotated by turning the locking cover that includes a central tubular cylinder for selective engagement with the actuating shaft. A pin mounted on the interior of the cover is receivable within one of three holes on an annular base plate that limits the rotation of the actuating shaft.

5 Claims, 2 Drawing Sheets

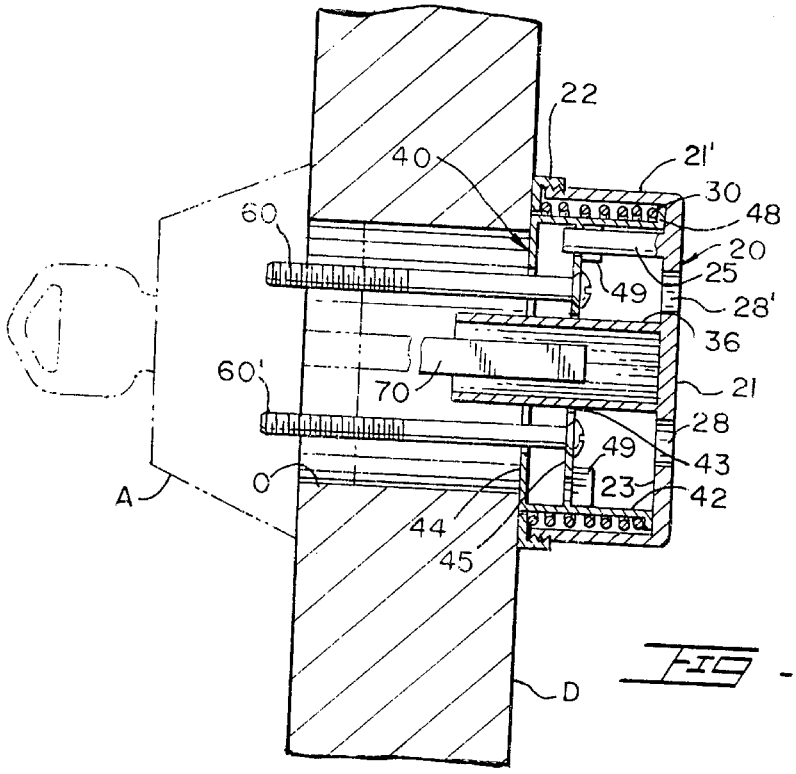
FIG - 4 -
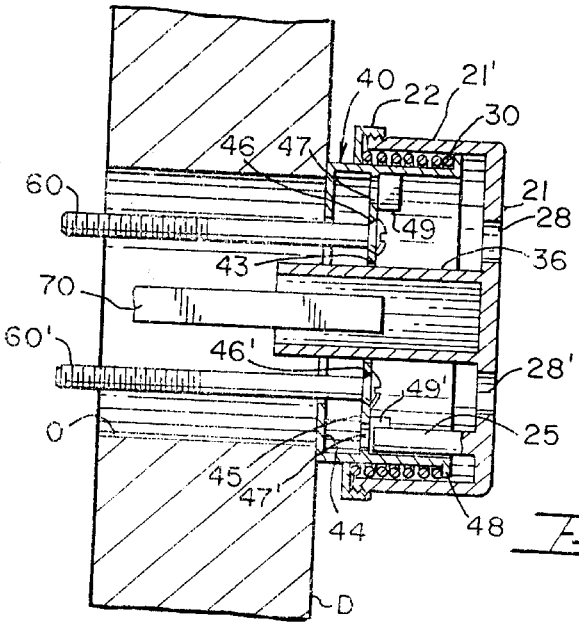
FIG - 5 -
FIG - 6A -
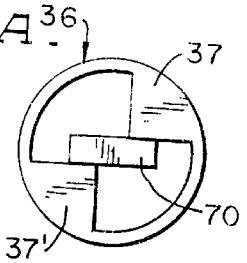
FIG - 6B -
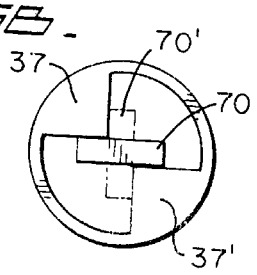
FIG - 6C -
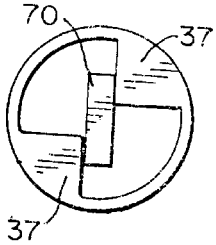

LOCKING COVER FOR DEAD BOLT ACTUATORS

BACKGROUND OF THE INVENTION

1. Field of the Invention.

The present invention relates to a locking cover assembly for dead bolt locks with actuator shafts, and more particularly, to the type that is used in conjunction with a closure member.

2. Description of the Related Art.

A conventional dead bolt lock assembly include an actuator shaft with an end extending towards the protected interior. A knob is typically mounted at the end of the actuator shaft to permit a user to rotate it and thus cause the dead bolt to protrude out or come within the closure member (usually a door). The conventional dead bolt assembly has an actuator shaft that has a rectangular cross-section, in most cases. The present invention permits a user to selectively limit the rotation of the actuator shaft by cooperatively positioning stopper members in the cover in one of three predetermined positions. In this manner an occupant of the protected premises may selectively position the cover to (a) be neutral and the dead bolt assembly operator normally; (b) limit the rotation of the actuator shaft to prevent the dead bolt from protruding out; and (c) limit the rotation of the actuator shaft to prevent the dead bolt from coming inside the closure member (unlocking the door). Under (b) and (c) a user outside the protected premises would not be able to lock (if in position b) or unlock (position c) the closure member.

Applicant believes that the closest reference corresponds to U.S. Pat. No. 5,313,812 issued to Eklund for a door lock security system. However, it differs from the present invention because it is a voluminous and complicated device that needs to be mechanically coupled with handle 46 which comes in a variety of designs, including round design (for which it will not operate). Also, off-centered portion 14 requires a structural modification of the closure member with the consequent inconvenience. Finally, and more important, the Patented device has a bulky "immobilizer" handle 46 whereas the present invention, as discussed above, permits a user to readily select one of three positions in a minimum of space.

Another relevant reference is U.S. Pat. No. 5,515,704 issued to Van Nguyen on May 14, 1996 for a security lock for a dead bolt lock assembly. As in the previous patent, the objective is to immobilize handle 36 requiring a mechanical structure to be attached to the closure member.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a locking cover assembly that permits a user to selectively limit the rotational movement of an actuating shaft or a dead bolt lock mounted on a closure member.

It is another object of this invention to provide a locking cover assembly that permits a user to lock a closure from inside of a dwelling even though a second party actuating the locking assembly with a key from the opposite side of the closure member would not be able to activate it.

It is still another object of the present invention to provide a locking cover assembly that is easy to install and manipulate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 is a partial cross sectional view of the present invention mounted on a door, having the pin member in the locked position (with the dead bolt protruding out).

FIG. 5 is a partial cross sectional view of the present invention, similar to the previous figure showing the spring in compression (the cover being pulled by a user) and the cover member rotated 180 degrees with respect FIG. 4 and with the pin in the unlocked position.

FIGS. 6A–C represents the three possible positions for the stopper edges of the cylindrical member.

DETAILED DESCRIPTION OF THE PREFERRED EMBODIMENT

Figure 1:
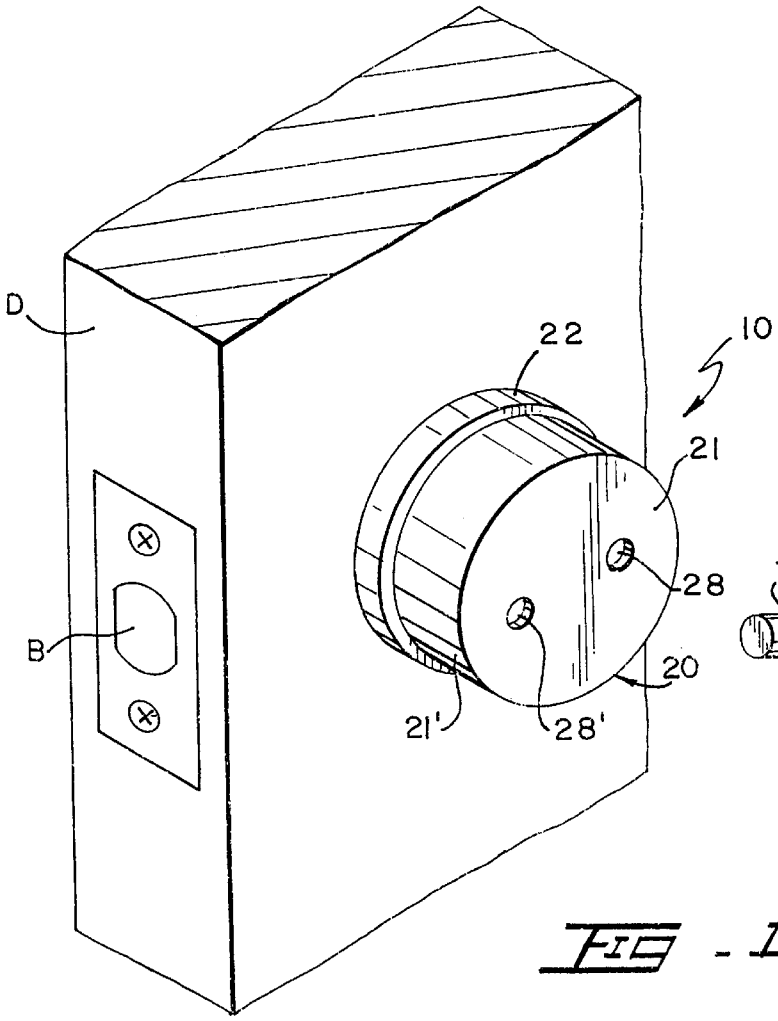
FIG. 1 is an isometric view of the present invention mounted on the interior wall of a closure member such as a door.

Referring now to the drawings, where the present invention is generally referred to with numeral 10, it can be observed that it basically includes cover assembly 20 with pin member 25 and cylindrical member 36 mounted inside. Annular threaded flange member 22 is peripherally mounted on cover assembly 20. Spring member 30 is trapped by cover assembly 20, annular threaded member 22 and base plate assembly 40. Base annular plate assembly 40 is rigidly mounted to the interior or protected wall of closure member D, which is typically a door.

Cover assembly 20, in the preferred embodiment, includes outer wall 21 and peripheral skirt member 21', extending from the edge of outer wall 21. Annular threaded flange member 22 cooperatively engages with the threaded edge of skirt 21'. Cover assembly 20 also includes inner surface 23. Pin member 25 is rigidly and perpendicularly mounted to inner surface 23. Cylindrical member 36 is centrally disposed within cover assembly 20. Cylindrical member 36, as illustrated in FIGS. 4; 5 and 6, is an elongated cylindrical tubular member and includes two opposite stopper edges 37 and 37' internally disposed. Stopper edges 37 and 37' extend radially inwardly from the interior walls of cylindrical member 36 and they are separated a sufficient distance to house actuating shaft member 70 so that cover assembly 20 can be selectively rotated one quarter of a turn without causing actuating shaft member 70 to rotate. If cover assembly 20 is rotated another quarter of a turn in the same direction then shaft 70 is also rotated. In this manner, actuating shaft member 70 causes dead bolt B of closure member D to either protrude out or collect itself within closure member D.

Figure 2:
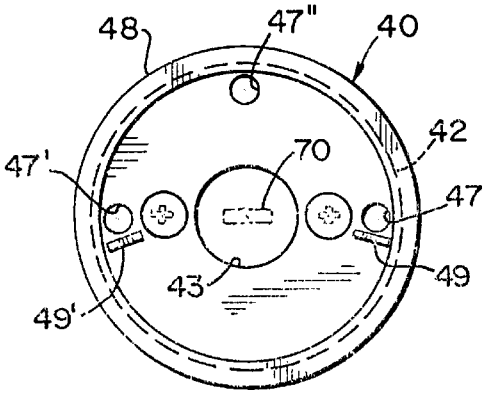
FIG. 2 is a top view of the annular base plate assembly used in one of the preferred embodiments of this invention fastened to the closure member.
Figure 3:
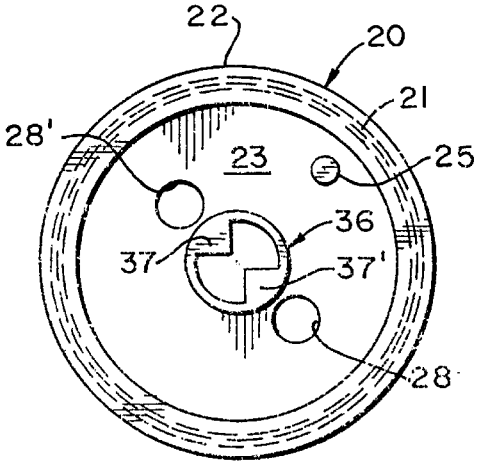
FIG. 3 is a bottom view of the cover member, used in this invention's embodiment.

In FIGS. 2; 4 and 5 base plate assembly 40 is shown. Base plate assembly 40 is rigidly mounted to the peripheral edge of through opening O of closure member D. Annular base plate assembly 40, in the preferred embodiment, is basically a cylindrical case member 42 with bottom wall 44, that rests against interior wall of closure member D adjacent to opening O. Upper annular wall 45 is located approximately in the longitudinal middle of cylindrical case member 42 and is parallel to bottom wall 44. Opening 43 on upper wall 45 is coaxially and centrally located to cooperatively allow cylindrical member 36 through. Upper wall 45 has holes 47; 47' and 47" located at upper wall 45 which are designed to cooperatively and selectively receive pin member 25 of cover assembly 20 in three positions. Hole 47 corresponds to the locked position, hole 47' to the unlocked position and 47" to the neutral position. These three positions are selected by a user's rotational movement of cover assembly 20. Guide members 49 and 49' end the angular travel of pin member 25. Guide members 49 and 49' are mounted on upper wall 45 of base plate assembly 40.

As illustrated in FIGS. 4 and 5, outer wall 21, skirt member 21', cylindrical case member 42 and flange 48 define an interior space for housing spring 30. Spring 30, housed within skirt member 21' and flange 48, is designed to bias cover assembly 20 against annular base plate assembly 40. This spring bias will ensure that pin 25 will be lodged at one of holes 47; 47' or 47", and thus immobilizing cover 10 and shaft 70.

As mentioned above, locking cover assembly 10 is mounted on closure member D in alignment with keyhole cylinder assembly A and interconnected through opening O. Cover assembly 10 can be easily mounted by inserting screws 60 and 60' through openings 28 and 28' located on wall 21, and through openings 46 and 46' located on upper wall 45 of annular base plate assembly 40 and finally through keyhole cylinder assembly A conventionally installed into closure member D.

In FIG. 6, stopper edges 37 and 37' are shown in the locked, neutral and unlocked positions from top to bottom, respectively, in this preferred embodiment. In the locked (upper figure) position, a user with a key would attempt to cause shaft 70 to rotate counterclockwise but shaft 70 will be obstructed by the horizontal edges of stopper members 37 and 37'. In the neutral position (middle figure) shaft 70 can be rotated in both directions (70 and 70') by a user with a key and therefore the deadbolt mechanism will behave as if cover 10 were not there. Lastly, in the unlock position (bottom figure) shaft 70 is kept at the end of its counterclockwise travel by the vertical edges.

Figure 7:
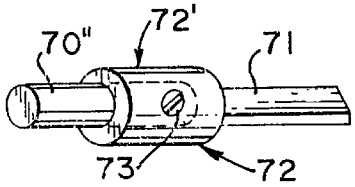
FIG. 7 represents an embodiment for an adapter to use for nonrectangular shafts found in some dead bolt lock assemblies.

In FIG. 7, adapter 72 includes tubular end 72' and shaft end 71 with a rectangular cross-section that is compatible with cover 10, as previously described. Adapter 72 is used with deadbolt assemblies that have shaft 70" with circular cross-section. Set screw 73 captures the end portion of shaft 70" that penetrates inside tubular end 72'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A locking cover for a dead bolt lock assembly mounted inside a through opening cooperatively positioned adjacent to the edge of a closure member having external and interior walls and said dead bolt lock assembly includes an actuating shaft member that is connected to, and driven by, a key cylinder assembly that causes it to selectively rotate thereby causing a dead bolt member to protrude and retract from an opening, and said actuating shaft member, having a rectangular cross-section, being also directly actionable, comprising:

A) an annular base plate assembly having a bottom wall adapted to be mounted to said interior wall and peripherally over said through opening and said annular base plate assembly includes a cylindrical case member extending perpendicular to said bottom wall; and B) cover means having an outer wall with a peripheral skirt and a centrally disposed tubular cylinder coaxially aligned with said skirt, and said tubular cylinder including a keyed stopper assembly mounted therein at a position that permits said actuating shaft member to go longitudinally into said keyed stopper assembly, and said keyed stopper assembly including two opposite stop members that extend radially inwardly from said tubular cylinder and separated a sufficient distance to permit said actuating shaft member thereinto so that said cover means is selectively rotated one quarter of a turn without causing said activating shaft member to rotate and the next quarter of a turn causes said dead bolt member to either protrude out or collect itself within said opening, and said cover means further includes an off centered pin mounted on an interior surface of said outer wall and said pin being cooperatively receivable within a plurality of holes in said base plate assembly to prevent said cover means from rotating when said cover means is brought against said annular base plate assembly.

2. The locking cover set forth in claim 1 further including:

C) spring means for biasing said cover means against said annular base plate assembly.

3. The locking cover set forth in claim 2 whereas said annular base plate assembly includes an upper annular wall parallel and spaced apart from said bottom wall and including two holes located on said upper annular wall, and further including fastening means that cooperatively pass through said two holes for firmly engaging said annular base plate assembly against said interior wall.

4. The locking cover set forth in claim 3 wherein said outer wall includes cooperatively positioned openings to permit a user to access said fastening means without removing said cover means.

5. The locking cover set forth in claim 4 wherein said upper annular wall includes guiding means for limiting the travel of said pin and facilitating locating said pin receivable holes.

* * * * *